United States Patent [19]

Townsend et al.

[11] Patent Number: 4,951,849

[45] Date of Patent: Aug. 28, 1990

[54] SEALANT APPLICATOR AND METHOD FOR AN AUTOMATIC FASTENER MACHINE

[75] Inventors: Harry E. Townsend; Paul J. Shemeta, both of Seattle, Wash.; Avinoam Zafir, Karmiel, Israel

[73] Assignee: The Boeing Company, Seattle, Wash.

[21] Appl. No.: 251,901

[22] Filed: Sep. 30, 1988

[51] Int. Cl.[5] ..... B05C 7/00; B21J 15/00

[52] U.S. Cl. ..... 222/523; 222/529; 29/34 B; 29/458; 118/254; 901/22; 901/43

[58] Field of Search ..... 222/523, 526–527, 222/529, 532; 239/281, 587, 205; 901/22, 43; 29/34 B, 458; 118/254

[56] References Cited

U.S. PATENT DOCUMENTS

| | | | |
|---|---|---|---|
| 2,316,307 | 4/1943 | Young | 222/523 X |
| 2,895,682 | 7/1959 | Tavone | 239/281 |
| 2,997,242 | 8/1961 | Grosholz | 239/281 |
| 3,335,753 | 8/1967 | Kiser | 251/9 X |
| 3,350,774 | 11/1967 | Bridges | 24/564 |
| 3,390,860 | 7/1968 | Kavanau | 251/9 |
| 3,531,054 | 9/1970 | Pulk | 239/587 |
| 3,606,162 | 9/1971 | Lehmann | 901/43 X |
| 3,654,959 | 4/1972 | Kassel | 137/605 |
| 3,904,718 | 9/1975 | Kuehn, Jr. | 264/39 |
| 3,921,820 | 11/1975 | Crockett | 901/22 X |
| 4,144,625 | 3/1979 | Hougenhout | 29/34 B |
| 4,229,136 | 10/1980 | Panissidi | 901/22 X |

*Primary Examiner*—Michael S. Huppert

*Attorney, Agent, or Firm*—Hughes & Multer

[57] ABSTRACT

An applicator for applying a fluid substance to a drilled hole as part of an automatic fastening machine. The fastener machine drills the hole in the workpiece, such as an aircraft wing panel, and then the substance applicator applies the substance to the hole, prior to subsequent installation of the fastener within the hole. The substance applicator, which is connected to a movable pressure foot, is pneumatically operated so that a head portion of the applicator is extended laterally over the hole, and a tip assembly in the head is extended vertically downward toward the hole. This operational sequence is accomplished by means of variable rate springs which bias the tip assembly and base to retracted positions. The substance is delivered to the tip assembly from a storage reservoir by means of a peristaltic pump. Positive shutoff of the substance to the tip assembly is achieved by a pivotally mounted shutoff arm assembly. When one end of the shutoff arm is engaged and elevated by the retracted head, the opposite end of the arm is depressed against the compressible tube to pinch off the sealant flow therethrough.

11 Claims, 12 Drawing Sheets

60
50
146
152
94
148
149
138
12
130
90
92
75
116
60
114
95
54
78
110
88
108
87
14
104
100
124
84
83
82
56
81
102
86
98
93
14
13
134
136
77
74
80
76
75
120
79
12
13
132
52
125
122

132
52
125
122
75
152
154
60
148
94
76
149
138
130
90
74
116
124
92
134
136
54
50

SEALANT APPLICATOR AND METHOD FOR AN AUTOMATIC FASTENER MACHINE

TECHNICAL FIELD

The present invention pertains to apparatus and methods for applying sealant in a hole as part of fastening process involving two or more parts, and more particularly to the application of sealant in a hole prior to installing a fastener bolt in an automatic fastening operation.

BACKGROUND OF THE INVENTION

In commercial aircraft production, conventional automatic riveting machines are utilized to attach the exterior panels of the aircraft wing to the underlying wing framework. The riveting machine typically includes three vertical spindles which extend downward rom a transfer carriage which is moved in a chordwise direction above the wing. The first spindle is typically a drill spindle which drills a hole through the wing panel and into the wing frame. The second spindle is a rivet fastener which installs the rivet and fastens the rivet within the hole. A third spindle cuts off the top of the rivet so that it is flush with the surface of the wing. During rivet installation, the transfer carriage is operated so that each spindle performs its operation sequentially and the rivets are installed in a spanwise row across the wing. Then the entire riveting assembly moves chordwise along the wing to install another spanwise row of rivets.

When installing fasteners made of materials which are dissimilar to the aircraft wing panels, such as when installing titanium fastener bolts to aluminum aircraft wing panels, it is necessary to provide a moisture barrier between the bolt and wing panel in order to prevent corrosion therebetween. This may be accomplished by automatically applying a sealant compound to the drilled hole prior to the installation of the titanium bolt. It is desirable, therefore, that this operation be performed quickly since there is a very short time span between drilling the hole and installing the fastener bolt in the hole.

There are other requirements for satisfactorily applying sealant to the bolt holes. For one, it is desirable to keep the sealant clean prior to the application of the fastener bolt. The drilling operation tends to distribute pieces of aluminum about the drill site, and can cause contamination of the sealant if it is not properly protected. Furthermore, it is important that the proper amount of sealant be applied to the hole. An insufficient amount of sealant will preclude a satisfactory barrier between the fastener bolt and the panel, whereas an excess of sealant is wasteful.

Conventional sealant applicators for automatic riveting machines have been disclosed. For example, in U.S. Pat. No. 4,144,625 by Hogenhout, and assigned to the Assignee of the present invention, there is described a sealant applicator for an automatic riveting machine whereby the applicator is vertically mounted to a drill-/riveter transfer carriage which in a first operational step extends downward where the applicator tip contacts an open sealant source, and in a second operational step the applicator tip is again extended downward to deposit the sealant in a rivet hole. Another sealant applicator assigned to the Assignee of the present invention is disclosed in U.S. 3,904,718 by Kuehn, Jr., which pertains to a sealant applicator for a countersunk hole whereby the applicator tip is first cleaned and then applied with sealant by means of a movable tape in a series of independent operations.

Another sealant applicator for an automatic riveting machine is disclosed in U.S. 3,350,774 by Bridges whereby the applicator is positioned in a rivet hole between a hole forming step and a rivet applying step, in order to apply sealant to the hole.

Other conventional flow control devices have also been disclosed. For example, in U.S. 3,335,753 by Kiser, there is disclosed a control valve for a beverage dispenser whereby the control valve operates to pinch off a flexible tube in order to control fluid flow through the tube.

Another fluid dispenser control mechanism is disclosed by Kavanau in U.S. 3,390,860 whereby a fluid dispenser utilizes a flexible fluid dispensing tube which is pinched off by an arm which is spring biased to the pinched off position.

Furthermore, in U.S. 3,654,959 by Kassel, there is disclosed a proportioning control valve for metering fluid through a tube whereby the control valve includes a pair of interconnected arms having spaced apart tips which pinch a flexible tube to deliver a periodic metered flow of fluid through the tube.

SUMMARY OF THE INVENTION

The present invention pertains to apparatus for applying a substance to a hole prior to an automated fastener installation within the hole. More particularly, the present invention operates in conjunction with an automated fastening machine for installing a fastener in a hole of a workpiece. The fastening machine, which is preferably an automatic wing panel fastener, includes a mounting member, such as an upper pressure foot, which is positioned at a lateral location from the hole. The substance applicator includes a base which is operatively attached to the mounting member, and a movable head which incorporates means for discharging the substance. There is further provided means for connecting the head to the base to permit the head, in response to a fluid pressure, to be moved in a generally lateral direction, from a first retracted position to a second extended position so that the substance discharge means is located above the hole; and to be moved back again to the first retracted position. Means are also provided for connecting the substance discharge means to the head to permit the substance discharge means, in response to the fluid pressure, to be moved from a third retracted position, in a direction downward toward the hole and to terminate at a fourth extended position; and to be moved back again to the third retracted position. In addition to the aforementioned elements, there is also provided means for delivering the substance to the substance discharge means for discharge of the substance into the hole. Also included are biasing means for sequencing the movement of the head and the substance discharge means so that the substance discharge means is located above the hole prior to the substance discharge means reaching the fourth extended position.

It is an object of the present invention to provide an applicator for quickly applying sealant to a workpiece so as to maintain the cleanliness of the sealant and to provide a controlled amount of sealant to the workpiece.

BRIEF DESCRIPTION OF THE DRAWINGS

This and other objects and advantages of the present invention will become more readily apparent upon reading the following detailed description and upon reference to the attached Drawings in which.

Figure 1:
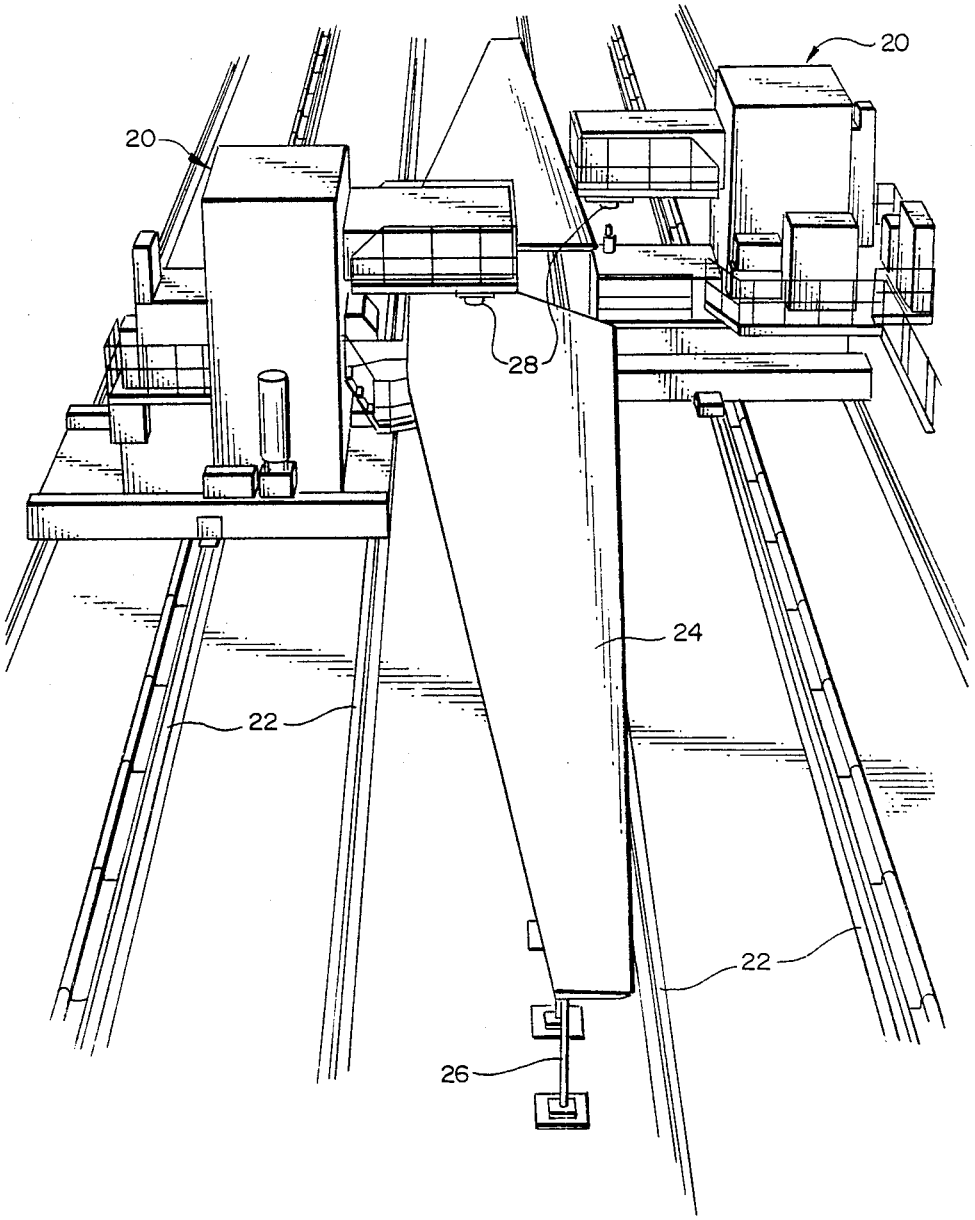
FIG. 1 is an environmental view showing a pair of conventional automatic riveting machines for fastening aircraft wing panels to an underlying frame.

While the present invention is susceptible to various modifications and alternative forms, specific embodiments thereof have been shown by way of example in the Drawings and will herein be described in detail. It should be understood, however, that it is not intended to limit the invention to the particular forms disclosed, but on the contrary, the intention is to cover all modifications, equivalents and alternatives falling within the spirit and scope of the invention.

DETAILED DESCRIPTION CF THE INVENTION

The present invention pertains to an applicator of sealant compound as part of an automatic fastening operation. In an exemplary embodiment, the automatic fastening operation utilizes a conventional aircraft automatic wing panel fastening machine such as the Model No. 767 manufactured by Gemcor of Buffalo, New York. It should be appreciated, however, that the applicator and method of the present invention may be used in other apparatus or processes involving the application of a fluidized medium to a substrate in an automated operation.

With regard to the exemplary embodiment utilizing an aircraft wing panel automatic fastening machine, the advantages of applying a sealant compound to a preformed hole have been disclosed in the Background of the Invention. That is, during the fastening of an aluminum skin panel to an underlying frame, the presence of a sealant prior to installing a fastener bolt made of a dissimilar material such as titanium, in a preformed wing panel hole, prevents corrosion from occurring at the titanium bolt/aluminum wing panel interface.

Prior to proceeding with a detailed description of the sealant applicator, a brief discussion of a conventional wing panel fastener and its operation in conjunction with the sealant applicator of the present invention will be provided.

Referring to FIG. 1, there is shown a conventional automatic wing panel fastening machine indicated at 20 which is movable along a set of ground tracks 22. A fastening operation is performed on a win 24 whereby individual aluminum panels are fastened to an underlying frame (not shown) of the wing. To perform this operation, the wing is elevated above the floor by hoists 26. Typically, the fastening operation is initiated with the fastening machine at the wing root, as shown in FIG. 1, or at the wingtip, and a movable spindle assembly 28 of the machine installs the bolts in a chordwise row across the wing. Upon completion of a row, the fastening machine 20 is repositioned along tracks 22 in a spanwise direction, in preparation for the installation of another row of fastener bolts. This operation continues until all of the panels are fastened to the wing.

Figure 2:
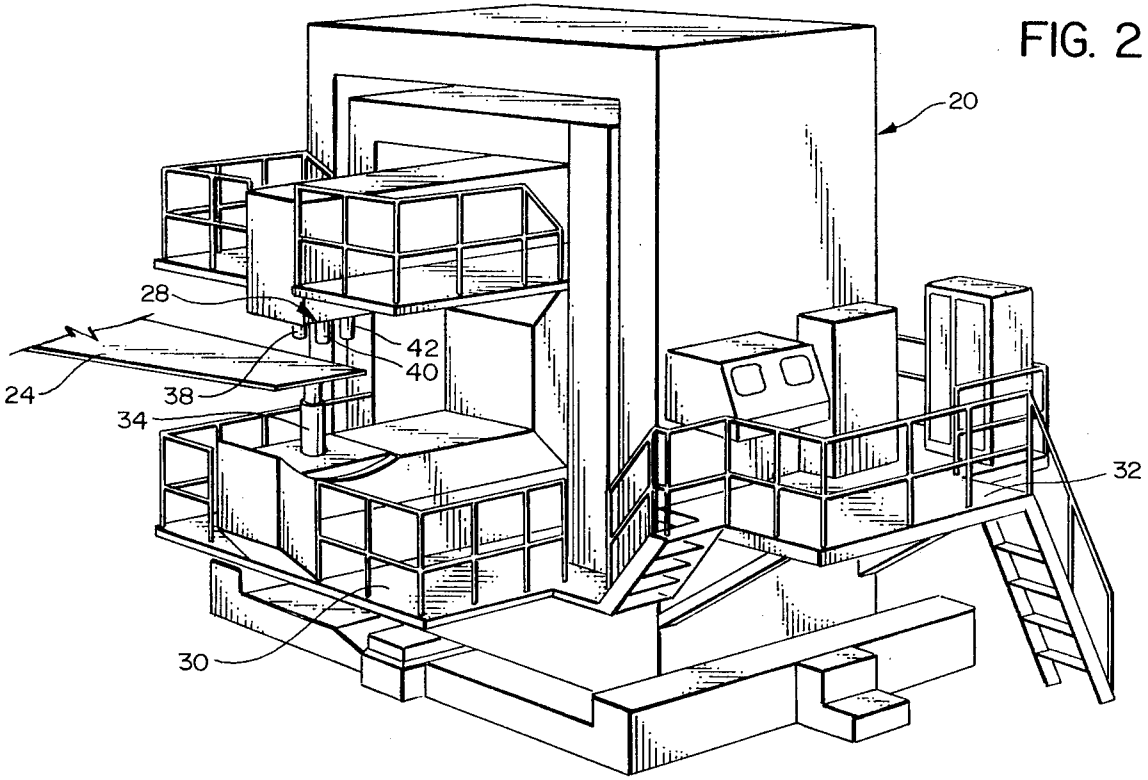
FIG. 2 is an isometric view of the automatic wing panel riveting machine.

Referring now to FIG. 2, fastening machine 20 is shown in more detail. There are included individual operator work stations 30 and 32 for controlling movement of the fastening machine along tracks 22, as well as to control the operation of the spindle assembly 28. More particularly, the spindle assembly includes a lower support foot 34 which is moved upwardly to engage the lower surface of the wing as part of the fastening operation, as well as an upper pressure foot indicated at 36 (not shown in FIG. 2, but shown in FIG. 3) which is moved downward to engage the upper surface of the wing. Positioned above the upper pressure foot is the spindle assembly 28 (FIG. 2) which includes three vertical spindles including an upset ram spindle 38, a shave spindle 40, and a drill spindle 42. For purposes of the present invention, only the drill spindle 42 and upset ram spindle 38 are utilized.

Figure 7A:
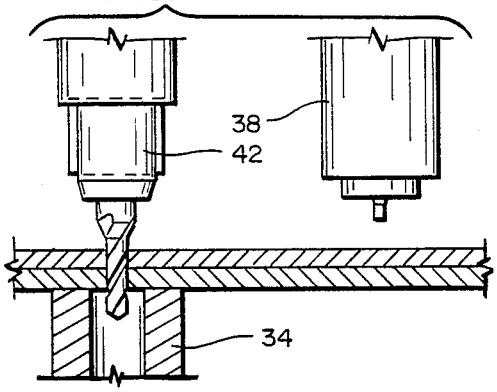
FIGS. 7A through 7F illustrate sequential operations of the automatic riveting machine including a conventional drilling operation, the sealant application operation of the present invention, and a conventional bolt fastening operation.
Figure 7B:
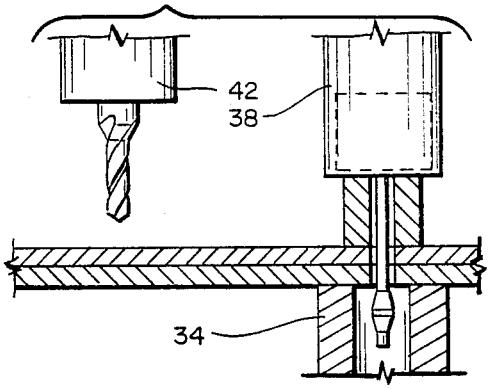
Figure 7C:
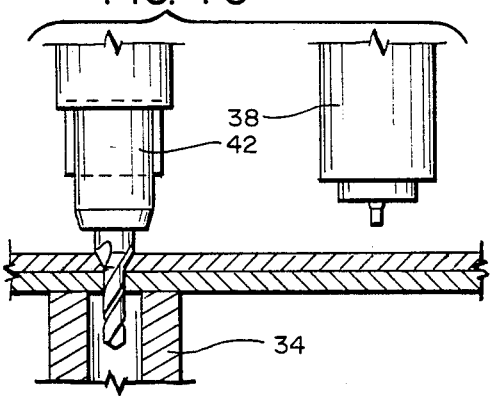
Figure 7D:
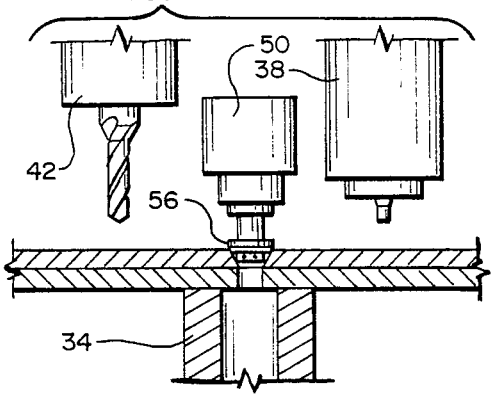
Figure 7E:
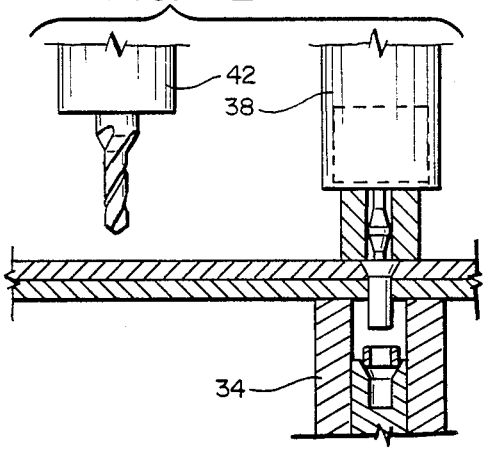
Figure 7F:
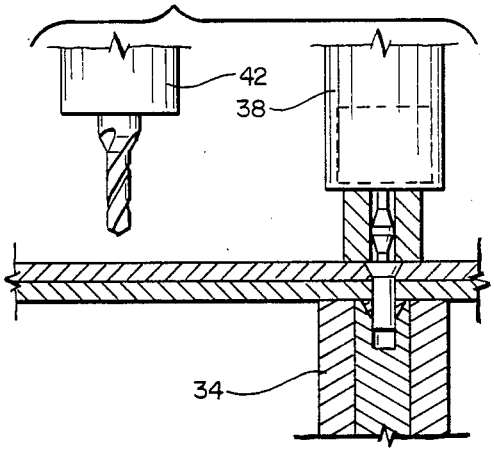

In operation, the spindle assembly is moved into position above the wing panel where the upper pressure foot 36 and lower support foot 34 (FIG. 3) converge into engagement with the wing. Subsequently, the drill spindle 42 (FIG. 2) is extended downward so that a drill bit on the end of the drill spindle is positioned through an opening 44 (FIG. 3) in the center of the floor of the upper pressure foot. After extension of the drill spindle, a hole is drilled through the wing panel and underlying frame as shown in FIG. 7A. Upon completion on the initial hole, the upset ram 38 is moved into position over the drilled hole, and the coldworking of the hole is accomplished as shown in FIG. 7B. Then, the top of the hole is counterbored by the drill spindle 42 as shown in FIG. 7C and a fastener bolt is fed to the upset ram. Sealant, such as chromated cellulose foam, is applied to the hole by a sealant applicator 50 as shown in FIG. 7D. A fastener bolt is then inserted into the hole and the fastening operation is completed by swaging a collar fastener to the stem of the fastener bolt by means of the upset ram 38 as shown in FIGS. 7E and 7F. In this operation the shave spindle is not used because the bolt is installed flush with the upper surface of the wing panel.

Figure 3:
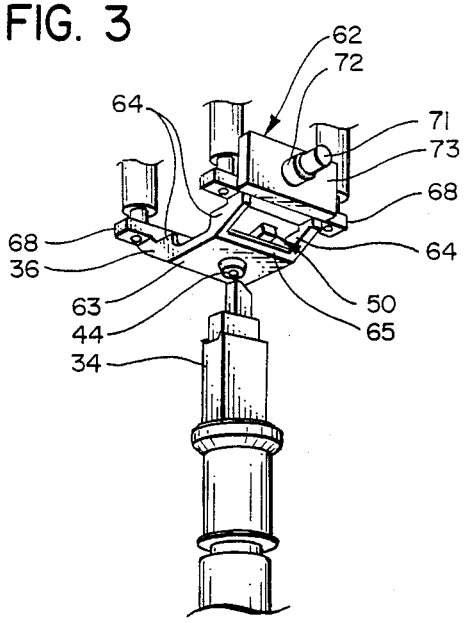
FIG. 3 is an isometric view of a conventional upper pressure foot assembly and a lower spindle assembly of the automatic riveting machine.
Figure 4:
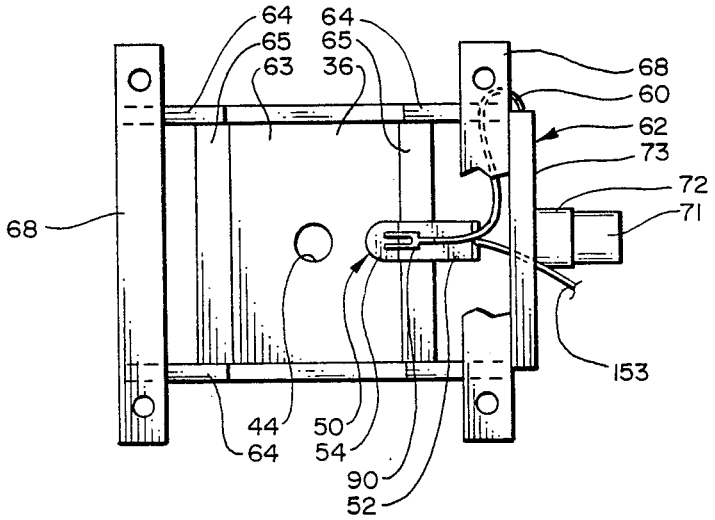
FIG. 4 is a top plan view showing a portion of the sealant applicator of the present invention attached to the riveting machine upper pressure foot.
Figure 5A:
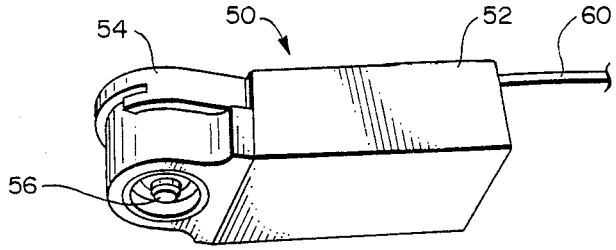
FIGS. 5A through 5E are isometric views of the sealant applicator at various positions during a sealant application cycle.
Figure 5B:
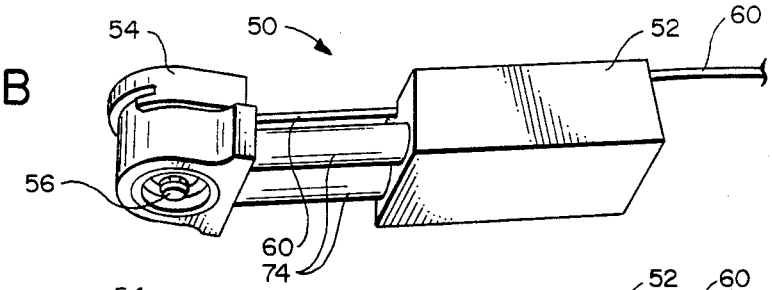
Figure 5C:
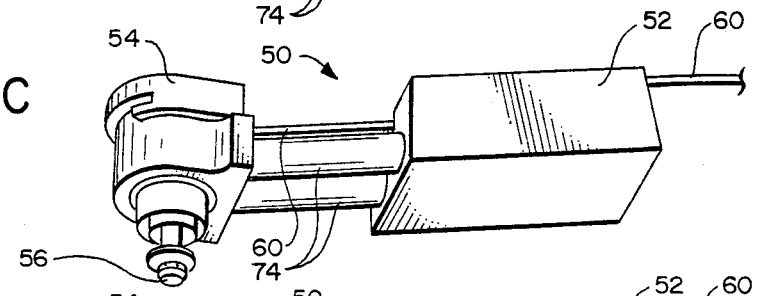
Figure 5D:
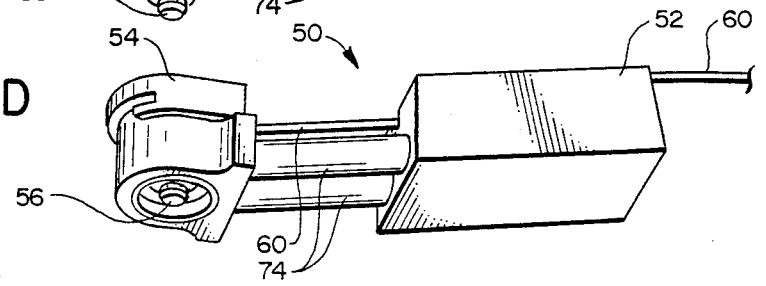
Figure 5E:
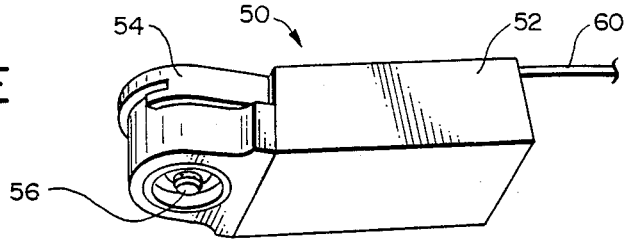
Figure 8:
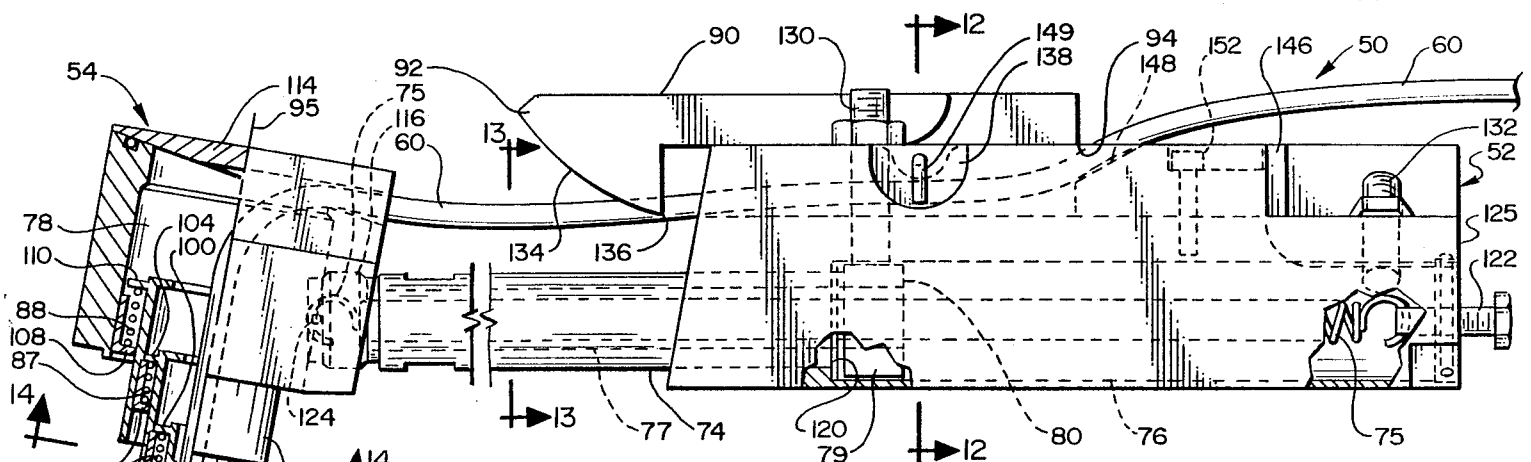
FIG. 8 is a side view of the applicator portion of the sealant applicator in an extended operative mode.

Having described the automatic wing fastening machine and its operation in conjunction with an application of sealant, attention will now be turned to the sealant applicator assembly of the present invention. Included in this assembly is the applicator indicated at 50 in FIGS. 5A through 5E, including a base 52, a horizontally extendable head 54, and a vertically extendable tip 56. The applicator base 52, in turn, is mounted to a slanted side portion of the upper pressure foot 36 as shown in FIGS. 3 and 4. The head 54 is cocked slightly as shown in FIG. 8 so that it may be extended laterally over the floor opening 44, and so that the tip 56 may be extended vertically through the floor opening 44 to apply sealant to the previously drilled hole in the wing panel.

Figure 15:
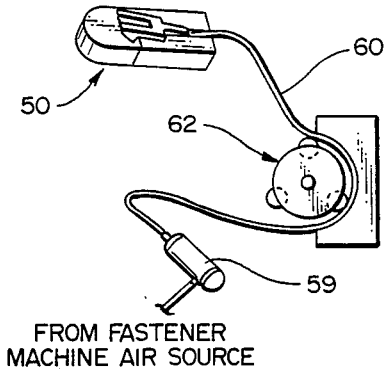
FIG. 15 is a simplified semi-schematic view of the applicator portion, pump portion, and sealant storage portion of the sealant applicator assembly.
Figure 17:
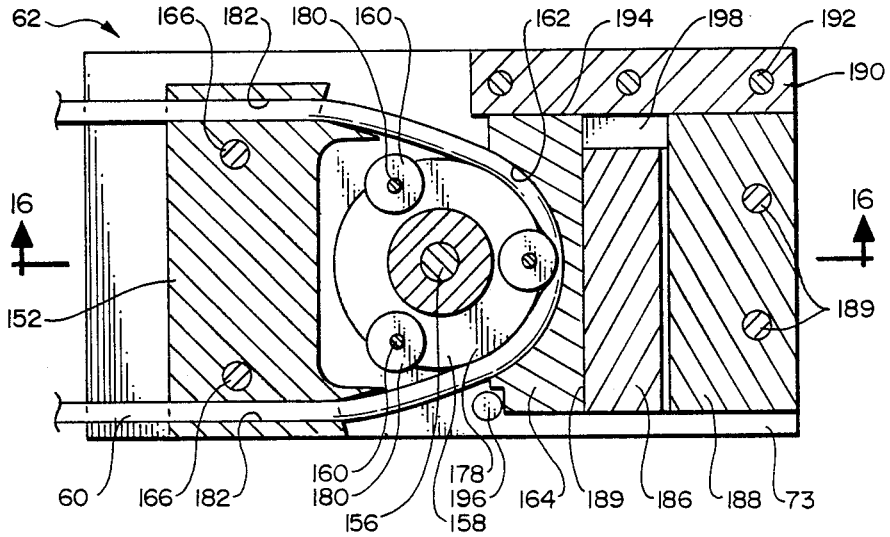
FIG. 17 is a top sectional view of the applicator pump taken along lines 17—17 of FIG. 16.

Sealant is delivered to the applicator 50 (FIG. 15) from a conventional sealant cartridge mounted in a conventional pneumatic sealant gun 59. Regulated air pressure which is tapped from an air distribution system of the automatic fastening machine is fed via an air hose (not shown) to the sealant gun 59. The pressurized sealant is delivered to the applicator via a disposable flexible conduit or tube 60 made out of polyurethane or the like. The sealant gun 59, which is mounted on the automatic fastening machine, delivers sealant to the applicator 50 by means of a peristaltic pump indicated at 62 which is intermediate the applicator 50 and reservoir 59. The pump 62 which is shown schematically in FIG. 15, and more accurately in FIG. 17, is attached to the side of pressure foot 36 as shown in FIG. 3.

To achieve an accurate metered flow of sealant to the applicator, pump 62 (FIG. 15) is a rotary peristaltic pump having a number of outer rollers which compress the flexible conduit 60. The pump rotates through a selected angular distance in order to dispense a constant volume of sealant through the conduit 60 to the applicator regardless of any changes in sealant viscosity.

In order to discharge the sealant into the drilled hole, the applicator head 54 is caused to extend laterally from the base 52 (FIG. 5B) and over the pressure foot opening 44. After extension of the applicator head, the applicator tip 56 is caused to extend downward (FIG. 5C) through the pressure foot opening 44 and into the drilled hole whereby the metered amount of sealant is discharged through the tip 56 and into the previously drilled hole. After discharge of the sealant, the tip 56 is retracted vertically into the head 54, and the head is retracted horizontally against the base 52 (FIG. 5E) and out of the way of the installation of the fastener bolt described previously with reference to FIGS. 7E and 7F. The applicator assembly of the present invention permits the quick application of clean sealant within the normal time interval between the counterboring of the wing panel hole and the installation of the fastener bolt, so that there is no slowdown in the wing panel fastener operation.

Figure 6:
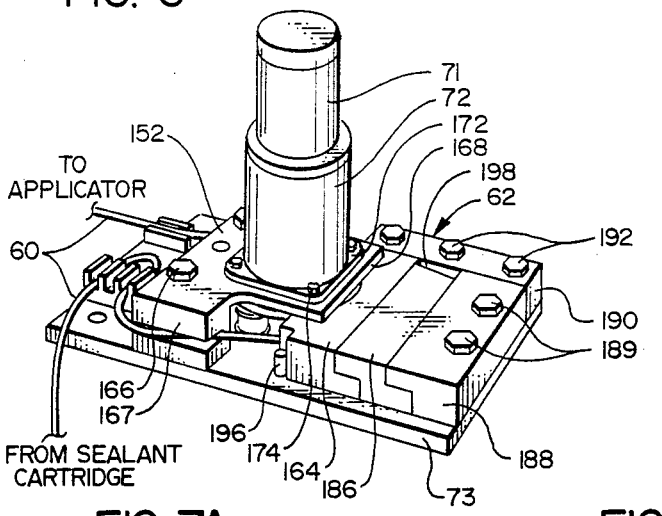
FIG. 6 is an isometric view of a pump portion of the applicator assembly of the present invention.

Referring now to the upper pressure foot 36 (FIGS. 3 and 4), there includes the lower horizontal rectangular floor 63 which has attached thereto at each corner an upward extending arm 64. An upwardly slanted sidewall 65 extends between arms 64 and is attached at its lower edge to floor 63. Extending horizontally across the left and right arms, respectively, and above the floor 63, are elongate bars 68; to one of which the pump 62 is fastened. More particularly, as shown in FIG. 6, the pump 62 includes a cylindrical vertically extending motor 71 and gearbox 72. In the present invention, a base 73 of the pump is fastened in a vertical manner to the side of the support bar 68 (FIG. 3).

Figure 9:
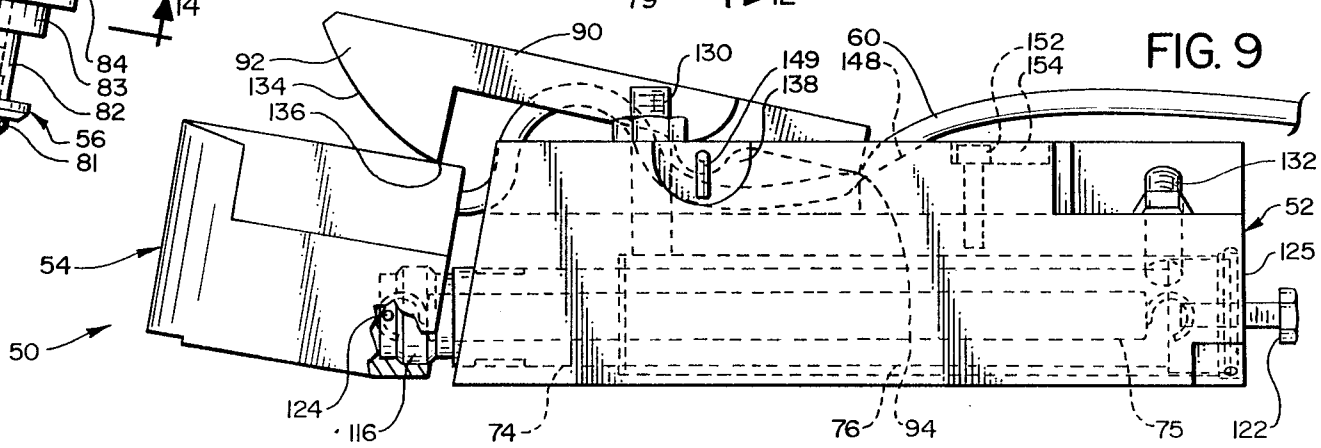
FIG. 9 is a side view of the applicator portion of the sealant applicator in a retracted mode.
Figure 10:
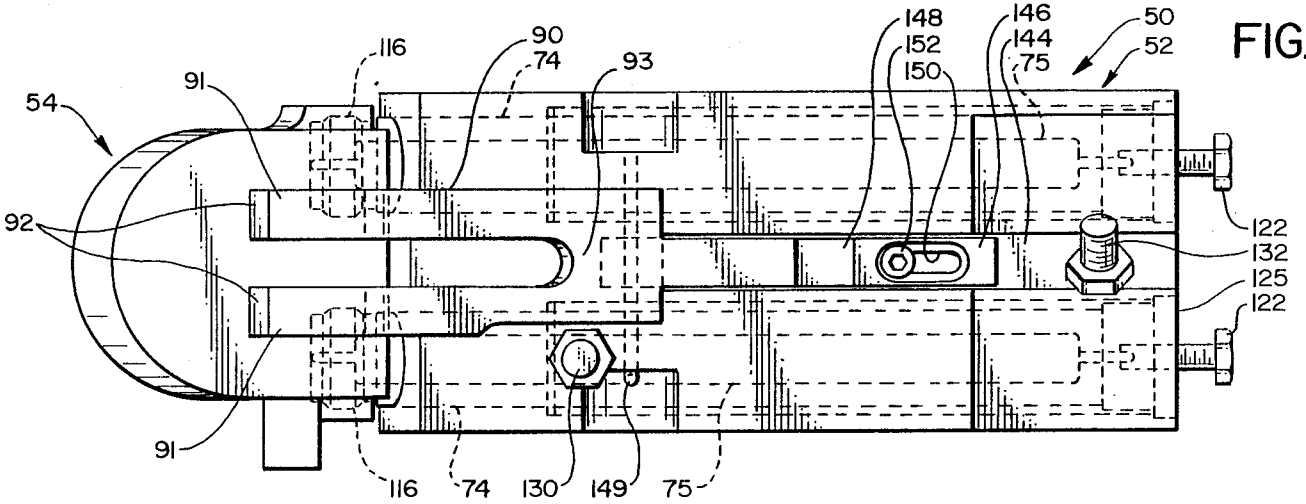
FIG. 10 is a top plan view of the applicator portion of the sealant applicator in the retracted mode.

With regard to the applicator 50, the base 52 (FIG. 4) has a rectangular configuration including a lower surface which is mounted on the upper surface of the sidewall 65. More specifically, as shown in FIGS. 8 through 10, the head 54 is supported by a pair of hollow horizontal tubes 74 which are slidably engaged within the base 52. Since both tubes 74 are identical, only one will be described hereinafter. The tube 74 is biased to a retracted position shown in FIG. 9 by a helical expansion spring 75, the right end of which is connected to the base 52, and the left end of which is attached to the left end of the support tube 74 (FIG. 8). In order to extend head 54 against the spring bias, air, which is supplied conventionally from the fastening machine, is delivered by means of an internal passageway 76 in the base 52 to a passageway 77 in the support tube 74, and on to a cavity 78 in the head. The air operates against a collar 79 attached to the right end of the support tube 74, as well as against the cavity walls of the head 54 to extend the head from the retracted position. The collar 79 includes an annular lip 80 which extends radially inward and which functions as a piston surface for pneumatically extending the slide tube 74.

In a similar manner, the tip assembly 56 is extended vertically from the head 54. More specifically, the tip assembly 56 telescopes between the extended position shown in FIG. 8, and the retracted position shown in FIG. 9 where the tip assembly is enclosed within the head 54. In this manner, the tip assembly is protected and remains free of foreign contaminates. The tip assembly 56 includes a tip 81 which is supported on a vertical hollow shaft 82 which, in turn, is slidably engaged within an upper hollow cylinder 83. The cylinder 83, in turn, is slidably engaged within another larger upper hollow cylinder 84 which, in turn, is slidably engaged within the larger cylindrical cavity 78. Each of the telescoping sections, i.e. shaft 82, and cylinders 83, 84, are biased to the retracted position within head cavity 78 by means of helical compression springs 86, 87 and 88, respectively. Extension of the tip assembly 56 against the bias of the springs is accomplished by means of the air delivered to the cavity 78, and which is fed through cylinders 83, 84 to the tip assembly 56. The passageway dimensions and the spring sizes are selected so that the extension and retraction operations occur in the desired order. That is, the head 54 extends first from the base 52, and then the tip assembly 56 extends from the head 54. It is desirable that just after the tip assembly is positioned above the floor opening, the tip 81 is extended through the floor opening. Thus, since the head is spaced apart from the floor during extension of the head, there may be some vertical extension of the tip. On the other hand, when the air pressure to the applicator assembly is terminated, the tip assembly retracts into the head 54, and when the tip 81 is clear of the floor opening 44, the head 54 retracts toward the base 52.

When not dispensing sealant through the tip, it is desirable that there be a positive shutoff of sealant through the applicator so there is no accidental leakage. This is accomplished in the present invention by means of a shutoff valve 90 (FIG. 9) which is pivotally connected to the top of the applicator base 52. The shutoff valve 90 includes a pair of arms 91 (FIG. 10), each of which has a left end 92 which engages the upper surface of the head 54 when the head is retracted. The arms join at the right ends to form a stem 93 having a right lower edge 94 (FIG. 9) which pinches off the flexible sealant tube 60 to prevent passage of the sealant therethrough when the head is retracted. During extension of the applicator head, the shutoff arms 91 rock about their pivot axes so that the left ends 92 are allowed to automatically drop downward as shown in FIG. 8, thereby elevating the right edge 94 and unpinching the sealant tube to allow delivery of sealant to the applicator tip. Upon retraction of the applicator head against the base, the left ends of the applicator arms 91 are caused to elevate, thereby depressing the opposite edge 94 and again pinching off the sealant tube 60 to prevent further passage of sealant therethrough.

Turning now to a more detailed discussion of the tip assembly 56, extension of the tip assembly occurs along a vertical axis designated by the line 95 in FIG. 8. Dispensing of the sealant occurs through the tip 81, which has a number of ports 93 extending radially from the axis 95. The tip, in turn, is screwed into the vertical tip shaft 82 which has an upper nipple 96 (FIG. 18) over which the sealant tube 60 is removably attached. Sealant is delivered to the outlet ports 93 from the nipple 96 by means of an internal passageway 97 in the tip shaft 82. Since the applicator base is mounted at an angle to the floor 63, extension of the support tubes 74 causes the head 54 to move slightly downward as well as laterally. However, the head 54 is connected to the support tubes 74 so that tip assembly axis 95 remains vertical.

In order to slidably engage the tip shaft 82 within the cylinder 83, cylinder 83 (FIG. 8) includes an inner cylindrical surface and an L-shaped annular collar stop 98 which is press fit inside the lower end of the cylinder 83. An inward extending cylindrical elbow of the collar slidably engages the outer surface of the tip shaft 82. The upper end of the collar 98 engages an outward extending annular lip 100 at the upper end of the tip shaft 82 to prevent further downward movement of the tip. The lip 100, in turn, extends inward and terminates at an outer vertical face which slides along the inner surface of the cylinder 83. In this manner, the tip shaft 82 is engaged for slidable vertical movement within the cylinder 83, with the lip 100 acting as a piston surface to aid in the pneumatic extension of the tip shaft. Furthermore, the tip shaft is biased in an upward direction inside the cylinder 83 by means of the spring 86 which is engaged about the tip shaft between the elbow of the collar 98 and the shaft upper lip 100.

In a similar manner, the cylinder 83 is slidably engaged within the cylinder 84. That is, the cylinder 84 includes an L-shaped annular collar 102 which is installed toward the lower end cf the cylinder and which has an elbow portion with a vertical end face which slidably engages the outer surface of the cylinder 83. The cylinder 83 is biased in an upward direction within the cylinder 84 by means of the spring 87 which is engaged about the cylinder 83 in a manner between the collar 102 and an annular outward extending lip 104 which extends around the upper end of the cylinder 84. Maximum downward extension of the cylinder 83 is reached when the upper lip 104 engages the upper end of the L-shaped collar 102. An airtight seal is provided by an outer vertical end face of the lip 104 which slides on the inner wall surface of the cylinder 84. Furthermore, a portion of the lip 104 extends inward of the housing wall to act an an upper stop for the tip shaft 82 during its retraction.

And, in addition, the cylinder 84 is slidably engaged within a cylindrical opening in a bottom surface of the head 54. More specifically, the interior cylindrical cavity 78 includes an annular L-shaped collar 108 having at its lower end an inward extending elbow portion which slidably engages the outer surface of the cylinder 84. The cylinder 84 is biased in an upWard direction within the head cavity 78 by means of the spring 88 which is engaged about the cylinder 84 in a manner between the lower elbow of the collar 108 and a circumferential outward extending lip 110 which extends around the upper end of the cylinder 84. A portion of the lip 110 extends radially inward to engage the lip 104 to prevent further upward retraction of the cylinder 84.

In order to enclose the head cavity 78, a head cap 114 is inserted over the upper opening in the cavity 78 and is secured to the remainder of the head 54 by a bolt (not shown). The right side of the head cap 114 (when viewing FIG. 8) has an outlet slot in communication with the cavity 78 for feeding the sealant conduit 60 to a location outside the head.

As discussed previously, the head 54 is supported by a pair of horizontal slide tubes 74, only one of which is shoWn in FIGS. 8 and 9, having the internal air passageways 77. At the left end of the slide tube 74 is a male threaded fitting 116 which is engaged within a complementary female threaded opening in the right side of the head 54. The slide tube 74, in turn, includes the outer collar 79 at its right end which slidably engages the inner surfaces of the cylindrical horizontal passageway 76 in the base 52. The slide tube 74 is retained within the base 52 when the left edge of the annular collar 79 engages a circumferential lip 120 on the inner surface of the left end of the passageway 76.

Biasing of the head 54 in the rightward, retracted direction is accomplished by the horizontal extension spring 75 which has a hooked left end which is attached about a horizontal pin 124 extending across the passageway 77, and a hooked right end which is attached to a slot in the left end of a bolt 122. The bolt 122 is threaded through the right vertical end 125 of the base 52.

Full extension of the head 54 is signaled by a conventional proximity switch 130 which is threaded through a vertical slot which terminates near the left end of the base passageway 76. The lower end of the proximity switch 130 barely engages the slide tube collar 79 at full extension of the head 54. Another conventional proximity switch 132 is mounted in a diagonal slot near the right end (FIG. 8) of the base passageway 76. The proximity switch 132 barely engages the collar 79 to signal full retraction of the slide tube 74. The signals generated upon full extension and retraction of the applicator head are fed to a main controller for reasons to be discussed later.

As discussed previously, the shutoff valve 90 (FIG. 8) is provided to pinch off the sealant tube 60 when the head 54 is retracted against the base. To accomplish this, each arm 91 includes a downward and rightward sloping curved end 134 which terminates at a lower point 136. Furthermore, intermediate between the left end and right end of the shutoff valve is a clevis 138 which depends downward from the valve stem and which is pivotally engaged to the top of the base 52. In operation, when the head 52 is retracted, the left end point 136 is supported on top of the head 54, thereby moving the right lower edge 94 of the valve to pinch off the sealant tube 60 against the upper surface of the base 52. Of course, when the head 54 extends, the left end of the valve drops down ahead of the left side of the base, thereby causing the right edge 94 to elevate and open the sealant conduit 60.

Figure 11:
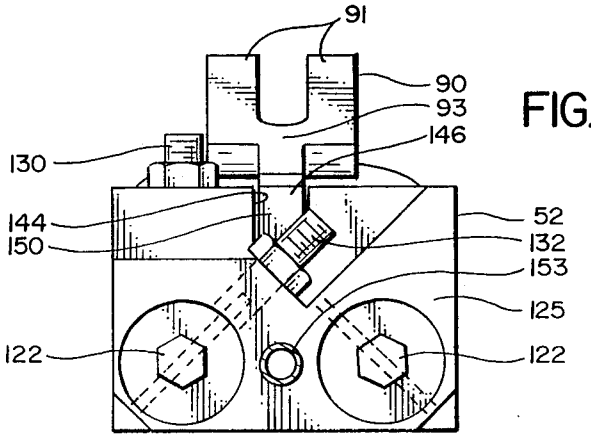
FIG. 11 is an end view of the applicator portion of the sealant applicator.
Figure 12:
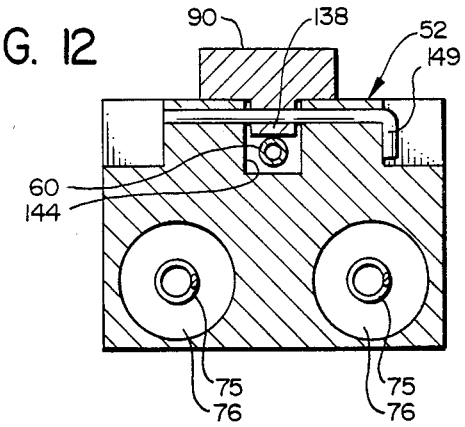
FIG. 12 is an end sectional view of the applicator portion taken along lines 12—12 of FIG. 8.
Figure 13:
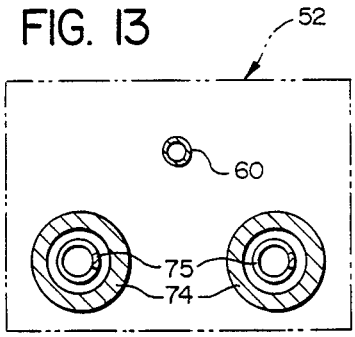
FIG. 13 is another end sectional view of the applicator portion taken along lines 13—13 of FIG. 8.
Figure 14:
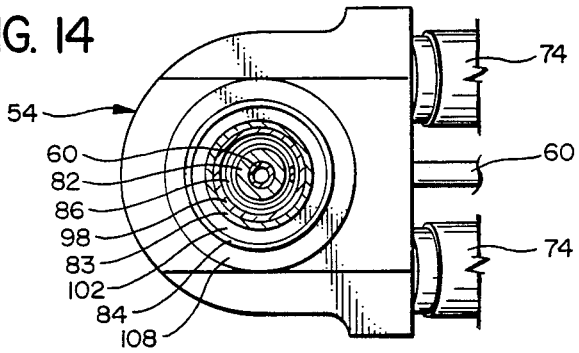
FIG. 14 is a cross-sectional view of the applicator tip portion taken along lines 14—14 of FIG. 8.

In order to describe the shutoff valve in more detail, reference is made to FIGS. 10 through 12. In order to accommodate the clevis 138 and the sealant conduit 60, the upper surface of the base 52 includes an open trough 144 extending in a lengthwise direction from the left end of the base to the right end. Located inside the trough 144 below the valve right edge 94 is a movable block 146 having a left pinchoff face 148 (FIG. 8) which slopes upward and rightward from the trough floor. The sealant tube 60 enters the left end of the trough 144, then extends between the clevis 138, and then rightward and upward over the pinchoff surface 148. In order to secure the shutoff valve to the base, a pin 149 (FIG. 10) is inserted transversely through openings in the clevis so that the ends of the pin are engaged in the base 52. The pinching off of sealant conduits of different diameters is accomplished by means of a vertical slot 150 in the pinchoff block 146. A fastener bolt 152, located within the slot 150, secures the block to the base 52. The pinchoff block is repositioned by untightening the fastener 152 and moving the block 150 in a leftward or rightward direction within the trough in accordance with the diameter of the sealant tube.

In an exemplary embodiment, in order to achieve the desired sequencing operation of the head 52 and applicator tip assembly 56 (FIG. 8), the head retraction spring 75 and tip retraction springs 86, 87, 88, are selected so that the head is fully extended before the tip assembly begins to extend. For the applicator to operate in this manner, the head retraction spring 75 is selected so that it generates a smaller retraction force at full retraction of the head, than the combined retraction forces generated by the tip retraction springs 86, 87, 88 at full retraction of the tip. In addition, to ensure full head and tip extension, the springs are selected so that full extension of the head and tip assembly occurs at a pressure less than the maximum air pressure delivered to the applicator base through the airline 153 (FIG. 4).

The spring rates can be calculated for all the springs using the transition pressure (the pressure at which the slide tubes are fully extended and the tip assembly has not started to move), the piston area of the slide tubes 74 (computer by the formula PI*d*d/4 where d is the diameter of the slilde tube collar 79 (FIG. 8), the piston area of the applicator elements (computed by the formula PI*d*d/4 where d is the diameter of each cylinder 110, 104, 100), the available system air pressure, and the translation distance for each piston. The spring constant for the head retraction spring 75 is calculated bythe formula K75=force at the end condition (fully extended) minus the pre-load force all divided by the translation ofthe slide tube. Similarly, the spring constants for each of the tip assembly springs 86, 87, 88 can be established using the end conditions. The extended spring force for the head retraction spring 75 is calculated by multiplying the slide tube area by the transition pressure (Ptp) minus five percent to assure proper sequencing. The pre-load force for the head retraction spring 75 is some nominal force to assure seating. The extended spring force (EF) for the applicator assembly springs 86, 87, 88 is calculated by multiplying the piston area by the maximum available air pressure minus five percent to assure extension. The pre-load (P) is calculated by multiplying the piston area by the transition pressure plus five percent to assure proper sequencing.

As an example, the spring constants for the present embodiment are calculated below:

Head Retraction Spring

S75 Pre-Load is set at some nominal value to assure seating of the head 54 P75=2#

S75 Extended Force (EF) occurs at the transition pressure (Ptp)

S75 EF=(PI*d**2/4)-Ptp−5%(PI*d**2/4)Ptp

S75 EF=PI*.625**2/4*25−5%7.67=7.3#

K S75=(7.3−2)/3.75=1.4 lbs. per inch

Applicator Tip Springs

Pre-Load

S 88p=AREA110 * PRESSUREtp+5% (A110 * Ptp)

A110=PI*d2/4=PI(1.3762)/4=1.487 sq. in.

S 88p=1.487 * 25+5% (37.175)=39.0 lbs.

S 87p=A104 * Ptp+5% (8.89)=9.3 lbs.

S 86p=A100 * Ptp+5% (3.8)=4.0 lbs.

Extended Force

S 88ef=AREA110 * PRESSUREmax −5% (A110 * Pmax)

S 88ef=1.487 * 50 −5% (74.35)=70.6 lbs.

S 87ef=0.356 * 50 −5% (7.8)=16.9 lbs.

S 86ef=0.152 * 50 −5% (7.6)=7.2 lbs.

Spring Constants

K 88=(Extended Force - Pre-Load)/Displacement

K 88=(70.6−39)/0.875=36.1 lbs. per inch

K 87=10.5 lbs. per inch

K 86=5.8 lbs. per inch

Once the spring constants are established the design of the springs (wire thickness, material, number of tunrs, coil diameter) is governed by standard spring design theory. As is typical in spring design, an iterative approach will probably be required.

In the exemplary embodiment in which the air pressure to the applicator base is about fifty psi, the head retraction spring 75 is formed from music wire of 0.024 inches diameter using 110 coils of 0.272 inches diameter, and spring 86 in the tip assembly is formed from music wire of 0.024 inches diameter using 6.5 coils of 0.300 inches diameter. Furthermore, the spring 87 is made from music wire of 0.036 inches diameter with 4.5 coils of 0.620 inches diameter, and the spring 88 is made from music wire of 0.040 inches diameter with 3 coils of 0.872 inches diameter.

The piston area of the tip elements are:

A110=1.487 sq. in.

A104=0.356 sq. in.

A100=0.152 sq. in.

Figure 16:
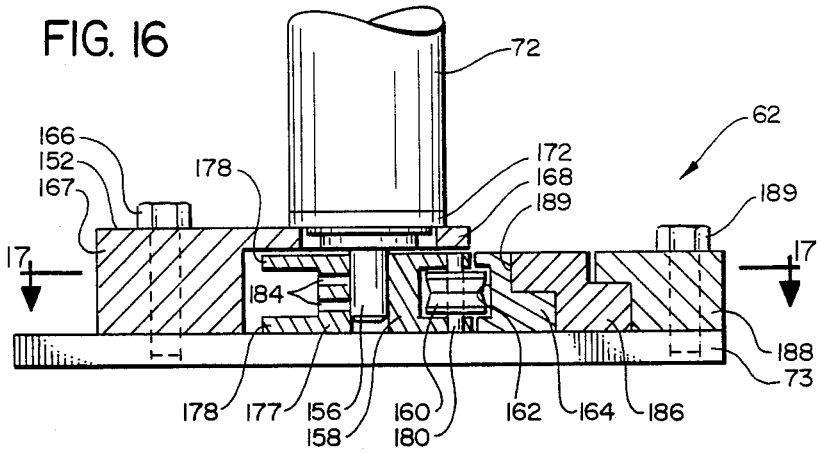
FIG. 16 is a side sectional view of the applicator pump taken along lines 16—16 of FIG. 17.

Having described the applicator 50, attention will now be turned to the pump assembly 62 shown in FIGS. 6, 16 and 17. Referring first to FIG. 6, the pump assembly includes the flat base plate 73 on which a motor mounting bracket 152 is fastened. Connected to the loWer end of the motor gear box 72 is a shaft 156 (FIG. 16) about which a rotatable roller holder 158 is mounted. The supplying of sealant to the applicator is accomplished by three rollers 160 (FIG. 17) which are rotatably mounted to the holder 158 and which compress the sealant conduit 60 against a curved surface 162 of a backing block 164. In order to dispense a constant volume of sealant regardless of the sealant viscosity, the roller holder 158 is caused to rotate through a predetermined angular distance by operation of the motor for a selected time.

More particularly, the mounting bracket 152 (FIG. 16) is connected to the upper surface and toward the left end of the base plate 73 by means of fastener bolts 166. To support the gear box and motor, the mounting bracket 152 includes a vertical base portion 167 and a ledge portion 168 which extends horizontally in a rightward direction above the upper surface of the base plate. The ledge 168 includes a central vertical opening through which the motor shaft 156 and gear box end plates extend in a downward direction. The gear box 72 includes a rectangular horizontal mounting flange 172 which is mounted about the lower end of the gear box and which is fastened to the upper surface of the ledge 168 by a number of fastener bolts 174 (FIG. 6). The roller holder 158 includes a central vertical base 177 (FIG. 16) and upper and lower horizontal circular plates 178 which extend radially outward from the central base. Each roller 160 is rotatably mounted about a pin 180 which extends vertically between the upper and lower plates 178 outward of the central base 177.

Attachment of the sealant conduit 60 to the pump is accomplished by feeding the tube through a first lengthwise extending slot 182 (FIG. 17) in the mounting bracket 152, around the roller holder, and between a roller 160 and the backing surface 162, and then back in a opposite direction through another slot 182 in the mounting bracket 152. In this manner, the sealant conduit wraps around the roller holder through an arc of about 160°. By placing the rollers 160 at locations approximately 120° apart around the roller holder 158, at least one of the rollers 160 is always in compressing engagement against the sealant conduit and backing surface 162 in order to supply sealant to the applicator.

Rotation of the motor shaft 156 about its vertical axis causes the rotation of the roller holder 158 which includes a vertical passageway extending through the central base portion 177 (FIG. 16). The drive shaft 156 is fitted inside the vertical passageway and is secured there by a number of set screws (not shown) which extend horizontally through slots 184 in the central base 177.

It is a significant feature of the present invention that the sealant tube 60 is easily replaced. During periods of nonuse, the sealant can harden inside the tube, necessitating its replacement. Removal of the sealant tube from the pump is accomplished by removing a wedge block 186 (FIG. 17) which is slidably engaged between the left backing block 164 and a right wedge holder block 188. More particularly, at the right side of the backing block 164 there is formed a vertical flat transverse surface which is parallel to the left side surface 189 of the wedge block 186. Likewise, the right side surface of the wedge block 186 is parallel to the vertical transverse left side surface of the wedge holder block 188. The wedge holder block 188, in turn, is fixed to the upper surface of the base plate 150 by fastener bolts 189. In this manner, the wedge block 186 is wedged between the wedge holder block 188 and the backing block 164. Removal of the sealant tube is accomplished by manually removing the wedge block 186, whereby the backing block, which is unattached from the base plate 73, is removed and the sealant tube is removed from around the roller.

When the wedge block 186 is inserted, the unattached backing block 164 is held in position by means of a positioning block 190 (FIG. 17) which is mounted to the upper surface of the base plate by a number of fasteners 192. The positioning block 190 engages an end 194 of the backing block so as to prevent transverse movement of the backing block in that direction. The opposite end of the backing block includes a notched left corner which engages a pin 196 upstanding from the upper surface of the base plate 73. With the backing block 164 securely wedged between the wedge block 186 and both the pin 196 as well as positioning block 190, positive securing of the backing block 164 to the base plate is accomplished.

It should be appreciated that removal of the wedge block 186 is facilitated by shortening the transverse dimension of the wedge block so that an opening 198 between the wedge block and the positioning block 190 is provided to permit the wegdge block to be grasped for its removal. Furthermore, as shown more clearly in FIG. 16, each roller 160 has a V-shaped outer surface to provide a recess for engaging the sealant conduit.

Figure 18:
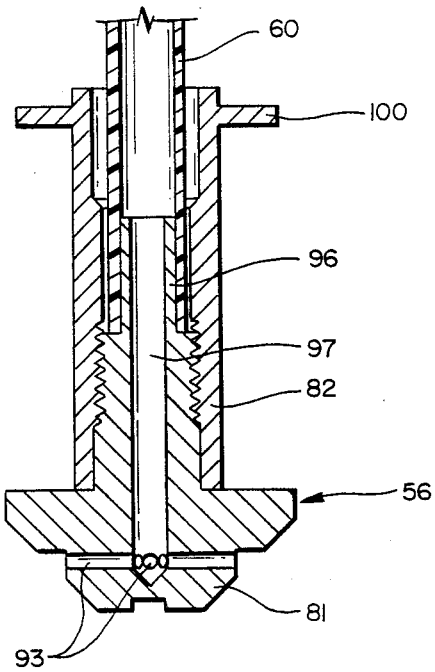
FIG. 18 is a side sectional view of a dispensing tip assembly of the applicator.

Referring now to FIG. 18, removal of the sealant tube from the applicator is achieved by unscrewing the applicator tip 81 from within the shaft 82 and removing the tip, shaft and the sealant conduit 60 from the head 54 and trough 144 of the base 52. The conduit is then removed from the tip nipple 96 (FIG. 18) and a new conduit is installed on the nipple and fed through the head and along the trough 144 in the applicator base.

Operation of the Gemcor fastening machine used in the exemplary embodiment of the present invention is controlled by a programmable microprocessor controller. Additional software programming of this microprocessor is necessary to operate the sealant applicator of the present invention. This operation is set forth in a simplified subroutine (FIG. 19) which occurs between the operations described previously of countersinking the drilled hole and installation of the fastener bolt.

Figure 19:
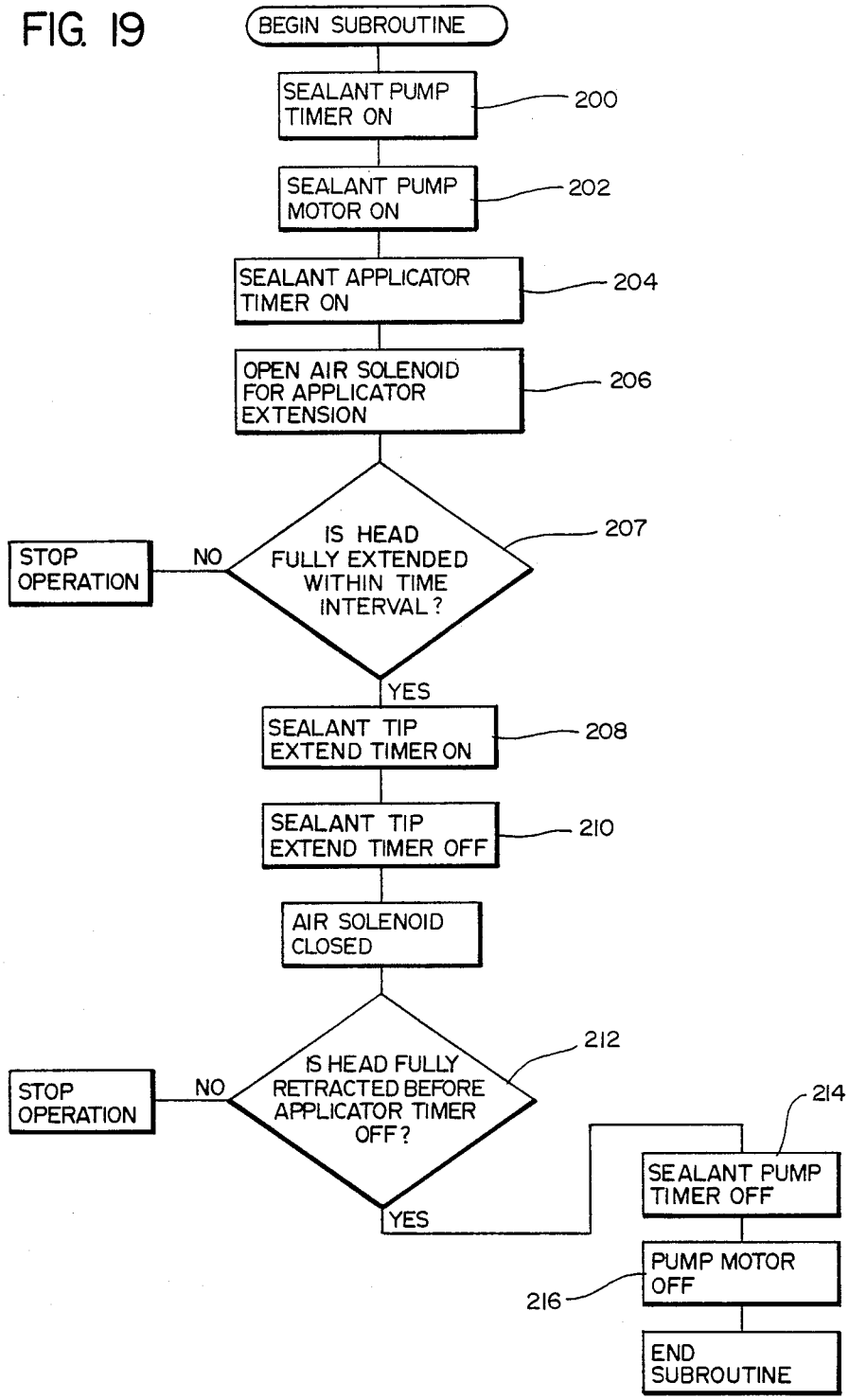
FIG. 19 is a flow chart describing a subroutine for controlling operation of the sealant applicator assembly.

Applicator operation is initiated by activation of a sealant pump timer at flow block 200 (FIG. 19). The interval set by the timer determines the amount of sealant delivered to the tip assembly. After activating a relay for turning on the pump 62 at flow block 202, a sealant applicator timer is activated at flow block 204. The time is set for the known total time interval (approximately one and a half seconds) for extension and retraction of the head 54 and tip assembly 56. Once the applicator timing cycle begins, a solenoid is opened at flow block 206 to deliver air from the air distribution system of the automatic fastener machine to the applicator base via the air line 153 (FIG. 4).

In order to determine whether the head 54 has jammed during extension, a signal is generated from the outer proximity switch 130 at full head extension. Non receipt of the full extension signal within a selected time interval of the applicator timer, generates an error message and automatic shutdown of the automatic fastening operation. On the other hand, receipt of the full extension signal within the selected time interval initiates a sealant tip extension timer at flow block 208. This time is set for the known time interval for extension of the tip assembly. Upon completion of the tip extension timing cycle, the timer shuts off at flow block 210 and the air solenoid is shut off at flow block 212. This results in retraction of the tip assembly within the head by means of springs 86, 87 and 88 and return of the head to the base by means of spring 75.

With return of the head to the base, the inner proximity switch 132 generates a signal at flow block 207. However, if the head has not fully retracted within the timing cycle established by the sealant application timer, a signal is generated which initiates an error message and termination of the automatic fastening operation. On the other hand, if the head retraction signal is received prior to termination of the applicator timing cycle, then operation of the automatic fastener continues with the shutting off of the sealant pump timer at flow block 214 and shutting off of the sealant pump motor at flow block 216.

A detailed program in ladder (relay) logic for the operation set forth in the above described flow chart is set forth in Appendix 1.

APPENDIX 1

```
    RE.W BEHLOK SEALANT APPLICATOR PROGRAM

!04301 01703 04011 04303 04305 02504 04211    500  !
+-] [---] [---]/[---] [---]/[---] [---]/[-+--(RTO)-+ SEALANT PUMP TIMER
!                                         !   0.1  !       ON
!04301 01504                              ! PR 007 !
+-]/[---] [-------------------------------+ AC 000 !
!                                                  !
!04301 01703 04011 04303 02504 04211 04305    502  !
+-] [---] [---]/[---] [---] [---]/[---]/[----(RTO)-+
!                                            0.1  !
!                                          PR 035 !
!                                          AC 000 !
!                                                  !
!50017 50015 04211 02504 02505 02506   01617 !
+-] [---]/[-+-]/[---] [---] [---] [-----( )--+   SEALANT PUMP ON
!           !                                !
!50215 04210!                                !
+-] [---]/[-+                                !
!                                            !
!50015 01617    510  !
+-] [---]/[----(TON)-+    SEALANT APPLICATOR TIMER ON
!               0.1  !
!             PR 005 !
!             AC 000 !
!                    !
!51017 51015 02504 02505 02506 02507   00717 !
+-] [---]/[-+-] [---] [---] [---] [-----( )--+  SEALANT APPLICATOR
!           !                                !      EXTEND
!01504      !                                !
+-] [-------+                                !
!                                            !
!01511 01703    506  !
+-] [---] [----(TON)-+    SEALANT DOBBER EXTEND TIMER ON
!               0.1  !
!             PR 003 !
!             AC 000 !
!                    !
!50617 50615   00716 !
+-] [---]/[-+---( )--+    SEALANT DOBBER TIP EXTEND
!           !        !
!01504 01511!        !
+-] [---] [-+        !
!           !        !
!01511 00716   04211 !
+-] [---] [-----(L)--+    SEALANT COMPLETE LATCH
!04211 50215 04210    500  !
+-]/[---] [---]/[-+--(RTR)-+
!                 !        !
!04312            ! PR 007 !
+-] [-------------+ AC 000 !
!                 !        !
!04501 04500      !        !
+-] [---] [-------+        !
!                 !        !
!04212            !        !
+-] [-------------+        !
!                          !
!50215 04211   04210 !
```

```
SEALANT 2ND TRY LATCH

+-] [---]/[-----(L)---+
!                     !
!04312          502   !
+-] [--------+--(RTR)-+
!            !        !
!04501 04500! PR 035  !
+-] [---] [-+ AC 000  !
!           !         !
!04212      !         !
+-] [-------+         !
!                     !
!04312          04210 !
+-] [--------+---(U)--+
!            !        !
!04501 04500!         !
+-] [---] [-+         !
!           !         !
!04212      !         !
+-] [-------+         !
!                     !
!04312          04211 !
+-] [--------+---(U)--+
!            !        !
!04501 04500!         !
+-] [---] [-+         !
!           !         !
!04212      !         !
!04312          04211 !
+-] [--------+---(U)--+
!            !        !
!04501 04500!         !
+-] [---] [-+         !
!           !         !
!04212      !         !
+-] [-------+         !
```

What is claimed is:

1. An apparatus for applying a substance to a hole of a workpiece prior to fastener installation, the apparatus comprising:

a. a base member;

b. a head including a substance discharge means for discharging the substance;

c. a first connecting means for connecting the head to the base to permit the head (i) in response to a first fluid force component which is responsive to variable fluid pressure, to be moved in a generally lateral direction from a first retracted position to a second extended position, so that the substance discharge means is located above the hole, and (ii) to be moved back to the first retracted position;

d. a second connecting means for connecting the substance discharge means to the head to permit the substance discharge means (i) in response to a second fluid force component which is responsive to variable fluid pressure, to be moved from a third retracted position in a direction downward toward the hole and to terminate at a fourth extended position, and (ii) to be moved back to the third retracted position e. a means for delivering the substance to the substance discharge means for discharge of the substance into the hole;

f. a first biasing means arranged to exert a first biasing force so as to oppose the first fluid force component and to resist movement of the head from the first retracted position to the second extended position;

g. a second biasing means arranged to exert a second biasing force so as to oppose the second fluid force component and to resist movement of the substance discharge means from the third retracted position to the fourth extended position;

h. the first and second biasing means being arranged in a manner that the first and second biasing forces are related to the first and second fluid force components so as to sequence the movements of the head and of the substance discharge means, so that the substance discharge means is located above the hole prior to the substance discharge means reaching the fourth extended position.

2. The apparatus as set forth in claim 1 wherein the first connecting means includes tube means having a first end portion which is connected to the head, and a second end portion which is slideably engaged within a first passageway in the base member so as to permit movement of the head between the first retracted position and the second extended position, the tube means including a second passageway in communication with the first passageway for transmitting the fluid pressure from the base member to the head so as to move the head from the first retracted position to the second extended position.

3. The apparatus as set forth in claim 2 wherein:

a. the second connecting means includes cylinder means which are slideably engaged to the head so as to permit movement of the substance discharge means between the third retracted position and the fourth extended position; and b. the head includes a third passageway which is in communication with the second passageway of the tube means, as well as with the cylinder means so as to transmit the fluid pressure between the second passageway and the cylinder means to move the substance discharge means to the fourth extended position.

4. The apparatus as set forth in claim 3 wherein:

a. the first and second biasing means include (1) first spring means which are connected between the base member and the head or tube means, (2) second spring means which are connected between the substance discharge means and the head; and b. the first spring means and the second spring means are formed so that the head extends over the hole before the substance discharge means reaches the fourth extended position.

5. The apparatus as set forth in claim 4 wherein:

a. the first spring means and the second spring means expand as the head and the substance discharge means, respectively, move to the second and fourth extended positions, respectively; and b. the first spring means is formed to extend at a faster rate than the second spring means so that the head is in the second extended position before the substance discharge means is in the fourth extended position.

6. The apparatus as set forth in claim 5 wherein the substance delivering means include:

a. compressible conduit means which are connected to the substance discharge means for delivering the substance thereto; and b. substance shutoff means, including a first end portion and a second end portion, which are connected to the base in a manner that i) when the head is in the first retracted position the shutoff first end portion engages the head to cause the shutoff second end portion to engage and compress the conduit means to prevent substance flow therethrough, and ii) when the head is in the second extended position the shutoff second end portion no longer compresses the conduit means so as to permit the flow of substance therethrough.

7. The apparatus as set forth in claim 6 wherein:

a. the substance shutoff means is connected to the base at a pivot location between the first end portion and the second end portion of the substance shutoff means;

b. the shutoff first end portion is supported on the head at an elevated location when the head is in the first retracted position causing the shutoff second end portion to be moved downWard about the pivot location to compress the conduit means; and c. the shutoff first end portion is located below the elevated location when the head is in the second extended position causing the shutoff second end portion to be moved upwards about the pivot location so that the conduit means is no longer compressed.

8. The apparatus as set forth in claim 7 wherein:

a. the conduit means extends across an exterior surface of the base where it is engaged and compressed between the shutoff second end portion and the exterior surface; and b. the shutoff first end portion includes an engaging surface which is sloped so that when the head is moved to the first retracted position, the head slidably moves across the engaging surface to cause the shutoff first end portion to move to the elevated location.

9. The apparatus as set forth in claim 8 wherein the substance delivery means further includes pump means for delivering a selected volume of the substance to the substance discharge means, the pump means including (1) a support base, (2) a backing member which is connected to the support base and which includes a curved engaging surface, (3) rotary means which are operatively connected to the support base, the rotary means including at least one engaging member for engaging the conduit means against the engaging surface to compress the conduit means therebetween during rotational movement of the engaging member with the rotary means, and (4) means for rotating the rotary means a selected amount so that the engaging member follows a path along the engaging surface to compress a selected length of the conduit means and to deliver the selected volume of the substance.

10. The apparatus as set forth in claim 9 wherein the pump means includes (1) a holding member which is fixed to the support base, (2) a wedge member which is removably wedged between the backing member and the holding member, and (3) positioning means which are fixed to the support base to removably secure the backing member between the wedge member and the positioning means so that the removal of the wedge means from between the backing member and the holding member allows displacement of the backing member from the positioning means and removal of the conduit means from between the engaging member and the backing member.

11. The apparatus as set forth in claim 1, wherein the variable fluid pressures which act to exert the first and second fluid force components are provided from a single fluid source.

* * * * *